United States Patent [19]

Roberts, Sr.

[11] Patent Number: 4,548,006

[45] Date of Patent: Oct. 22, 1985

[54] SELF-FLASHING CHANNELED SKYLIGHT

[76] Inventor: Joseph W. Roberts, Sr., 413 Virginia Dr., Orlando, Fla. 32803

[21] Appl. No.: 650,582

[22] Filed: Sep. 13, 1984

[51] Int. Cl.[4] ..... E04B 7/18

[52] U.S. Cl. ..... 52/200; 52/533

[58] Field of Search ..... 52/200, 533, 18, 72

[56] References Cited

FOREIGN PATENT DOCUMENTS

| | | | |
|---|---|---|---|
| 2430182 | 1/1976 | Fed. Rep. of Germany | 52/200 |
| 1307449 | 9/1962 | France | 52/200 |
| 56011 | 4/1922 | Sweden | 52/200 |
| 1574546 | 9/1980 | United Kingdom | 52/200 |
| 220462 | 6/1968 | U.S.S.R. | 52/200 |

OTHER PUBLICATIONS

Sweet's Catalog, 1979, vol. 4, Sec. 7.8/Tu.

*Primary Examiner*—Donald G. Kelly
*Assistant Examiner*—Caroline Dennison
*Attorney, Agent, or Firm*—Duckworth, Allen, Dyer & Pettis

[57] ABSTRACT

A self flashing skylight for installation on the downwardly sloping roof is disclosed, in which a central portion is convexly curved and the side edges are provided with channels adjacent the convexly curved portion so that rain water impinging on the skylight will tend to be diverted into the channels which direct the water to the bottom of the skylight.

4 Claims, 3 Drawing Figures

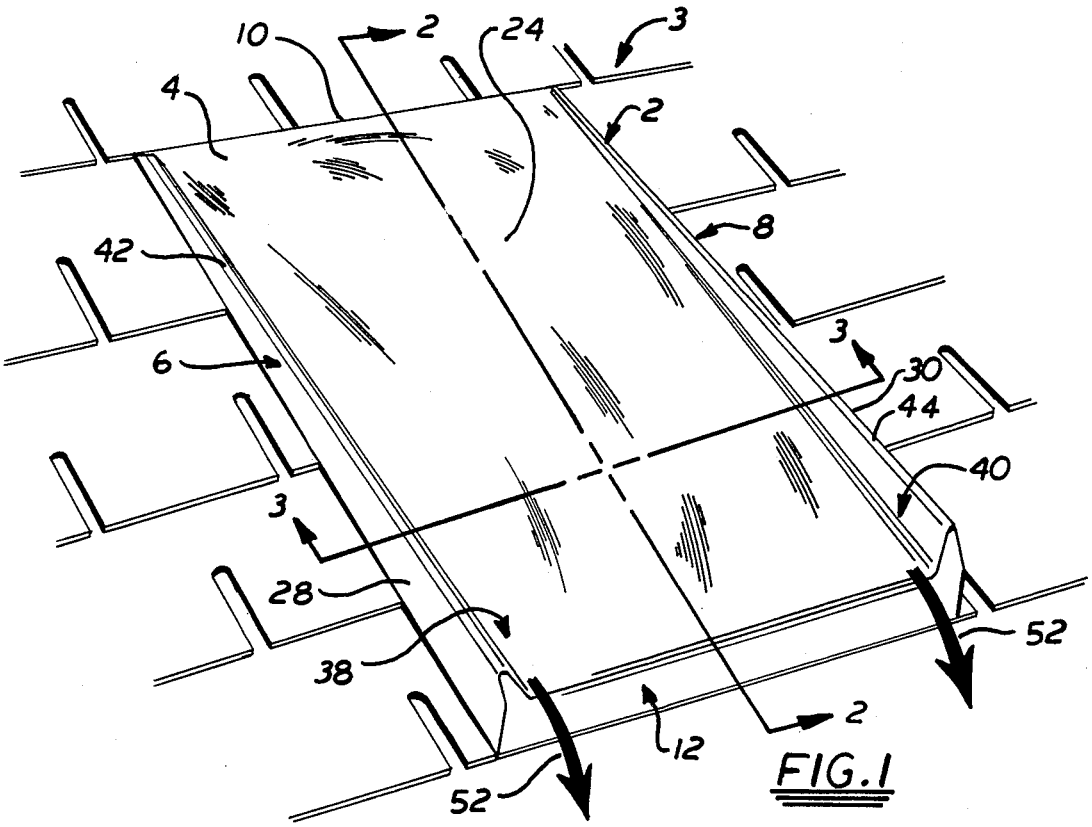
FIG. 1
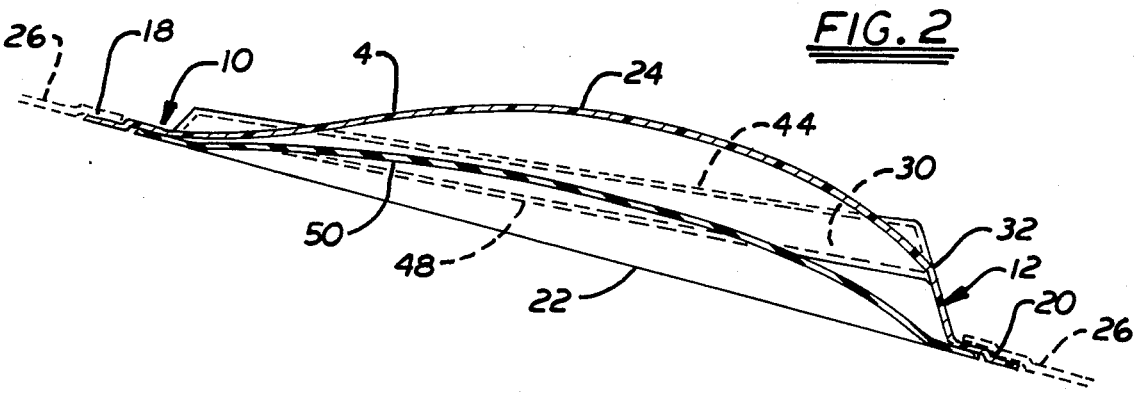
FIG. 2
FIG. 3
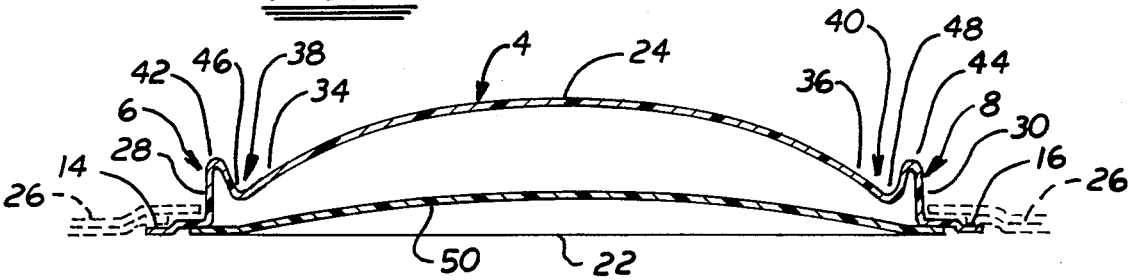

SELF-FLASHING CHANNELED SKYLIGHT

BACKGROUND OF THE INVENTION

This invention relates generally to the field of skylights and more particularly to self-flashing skylights designed for installation on a downwardly sloped roof.

In the field of skylight design and construction numerous configurations have been developed and utilized. These configurations have taken many shapes, although the square or rectangular shape is most common due to ease of installation provided between roof joists. Among the most common types are those having a flat or convexly curved light-transmissive portion of clear or translucent material, such as glass or synthetic resin. Most commonly these light-transmissive portions are mounted within a framework of wood or metal that is then mounted to the roof of the building involved. Some of these prior art units have been "self-flashing" in that the structure of the skylight unit itself includes flanges over which is laid the roofing material to provide a more waterproof joint between the skylight and the roof. However, even the self-flashing structures have frequently experienced leakage, particularly where a light-transmissive portion is convexly curved, because rain water is deflected around the edges of the skylight, toward the very edges where the joints between the skylight and the roof may permit such leakage. This problem frequently is especially bad where the bottom of the skylight joins the roof, since water running over the skylight may thereby be directed under the roofing material.

SUMMARY OF THE INVENTION

In view of the above-noted disadvantages of the prior art structures, it is an object of the present invention to provide a self-flashing skylight structure whose configuration reduces the tendency for leakage of rain water under the joints between the skylight and the roof. More particularly, it is an object of the present invention to provide such a skylight that promotes the flow of rainwater over the skylight in such a manner as to reduce the tendency of that rainwater to contact the joints between the skylight and the roof.

To achieve these and other objects, which will become clear below, a self-flashing skylight is disclosed which comprises a generally rectangular light-transmissive member having two mutually opposed side edges and opposed top and bottom edges with convexly curved central portion. The skylight includes flange portions extending outwardly from each of the four edges to define a base plane of the skylight, with the side edges and bottom edge each having a generally upwardly extending wall portion interposed between the respective flange portion and the convexly curved central portion. The side edge wall portions each extend above the level of the adjacent outermost part of the convexly curved central portion to form concave channels where each of the side wall portions join the convexly curved central portion. In a preferred embodiment of this invention the upward extent of the side edge wall portion above the skylight base plane and the height of the lowermost portion of the respective concave channel increase between the skylight top edge and the skylight bottom edge to provide a generally wedge shaped configuration in side elevation.

BRIEF DESCRIPTION OF THE DRAWINGS

A preferred embodiment of the structure of this invention will be described in detail below in which:

FIG. 1 is a perspective view of a preferred embodiment of the structure of this invention;

FIG. 2 is a side sectional view taken along line 2—2 of FIG. 1; and

FIG. 3 is an end sectional view taken along lines 3—3 of FIG. 1.

DESCRIPTION OF A PREFERRED EMBODIMENT

In the illustration of FIG. 1, depicting a preferred embodiment of this invention, there is illustrated a self-flashing skylight, which suitably may be formed of a substantially rigid, light-transmissive material, such as polycarbonate plastic, or other suitable material. This skylight is generally indicated by reference numeral 2 and is depicted in FIG. 1 as being installed on a downwardly sloping roof 3.

The skylight structure itself, such as the unitary formed plastic member 4 is provided on each of the two mutually opposed side edges 6 and 8 and on the top edge 10 and bottom edge 12 a flange portion extending outwardly from each of those four edges. The flange portions associated with the respective side edges 6 and 8 are indicated by reference numerals 14 and 16, respectively, as shown in FIG. 3. In FIG. 2 are illustrated the top edge flange portion 18 and bottom edge flange portion 20. These flange portions 14, 16, 18 and 20 preferably lie in a common plane, defined as the base plane 22 of the skylight, which may correspond to the roof structure to which this skylight is attached. Between each of these edges is the center portion which is convexly curved and indicated by reference numeral 24.

As shown in FIGS. 2 and 3, the roofing material 26 (shown in phantom) overlaps these flange portions 14, 16, 18 and 20 and may preferably be attached to those flange portions by an appropriate adhesive. With this overlap of the roofing material the flanges thus provide for the flashing that might otherwise be necessary, thus, rendering such a skylight structure "self-flashing." The skylight itself is affixed to the roof structure by appropriate means, which may suitably include adhesives and fasteners such as nails or screws.

The two side edges 6 and 8 both include generally upwardly extending wall portions 28 and 30, respectively, interposed between the respective flange portions 14 and 16 and the convexly curved central portion 24. Similarly, the bottom edge 12 also includes a generally upwardly extending wall portion 32 interposed between the bottom edge flange portion 20 and the convexly curved central portion 24 of the skylight.

As illustrated best in FIG. 3, the side edge wall portions 28 and 30 each extend above the level of the adjacent outermost parts 34 and 36 of the convexly curved central portion 24. Such upward extent thus forms along each side of the skylight a concave channel, with channel 38 thus being formed adjacent side edge 6 and channel 40 being formed adjacent side edge 8. The uppermost portion and thus the upward extent of the side edge wall portion 28 is indicated by reference numeral 42, and the corresponding upward extent of side edge wall portion 30 is indicated by reference numeral 44. Similarly, the lowermost portion of the respective concave channels 38 and 40 are indicated by reference numerals 46 and 48 in FIG. 3. As is shown most clearly in the perspective view of FIG. 1 and also in phantom on the side sectional view of FIG. 2, the upward extent of the side edge wall portions 6 and 8, which upward extent is defined by the uppermost portion 42 and 44 above the base plane 22, and the height of the lowermost portion 46 and 48 of the respective concave channels 38 and 40 increase between the skylight top edge 10 and the skylight bottom edge 12, thus giving a somewhat wedge-shaped configuration to the skylight in the side elevational of FIG. 2. The purpose of this wedge-shape configuration will be described in more detail below.

To provide a dead air space to reduce condensation and provide insulation, a second light-transmissive member 50 is also provided spaced between the convexly curved central portion 24 of the first unitary member 4 of the skylight and the skylight base plane 22. This second member 50 preferably extends between the four flange portions, thus forming a dead air space between the first light-transmissive member 4 and the second light-transmissive member 50.

Among the substantial advantages of the structure of this skylight are both its ease of installation and the reduction of any tendency to leak rainwater. These benefits arise not only from the construction, in which the exterior portion of the skylight is formed of a single unitary member, but also by virtue of its configuration. By having the self-flashing flange 18 of the top edge extend under the roofing material 26, there is little tendency to leak at the top edge. Additionally, the channels 38 and 40 reduce the tendency for side leakage commonly experienced with prior art convexly curved skylights. These prior art skylights have a tendency to leak along the sides because the convex curvature of the central portion diverts the water toward those side joints between the skylight and the roofing material. However, with skylight of this invention that water is diverted to the side and then captured within the channels 38 and 40, which tend to prevent the rainwater from going off the side, but instead carry it down the skylight to be directed off the bottom edge. Furthermore, the wedge-shaped arrangement, and the upwardly extending bottom edge wall 32 tend to create a "ski-jump" effect so that water flowing rapidly down the skylight will tend to jump over the joint between the roofing material 26 and the bottom edge flange 20, as indicated by the bold arrows 52 in FIG. 1, thus again reducing the tendency to leak. Accordingly, the skylight structure of this invention provides substantial benefits, compared to corresponding prior art structures installed on such downwardly sloping roofs.

While the foregoing describes a particularly preferred embodiment of the skylight of this invention, it is to be understood that such description is illustrative only of the principles of the invention and is not to be considered limitative thereof. Because numerous variations and modifications of this structure, all within the scope of the invention, will readily occur to those skilled in the art, the scope of this invention is to be limited solely by the claims appended hereto.

What is claimed is:

1. An improved self-flashing skylight for installation on a downwardly sloped roof, said skylight comprising a generally rectangular, light-transmissive member having two mutually opposed side edges and opposed top and bottom edges and a convexly curved central portion extending between these edges and having flange portions extending outwardly from each of the four edges to define a base plane of the skylight, with said side edges and said bottom edge each having a generally upwardly extending wall portion interposed between the respective said flange portion and said convexly curved central portion, with said side edge wall portions each extending above the level of the adjacent outermost part of said convexly curved portion to form a concave channel where each said wall portion joins said convexly curved central portion.

2. The improved skylight of claim 1 wherein the upward extent of said side edge wall portions above said skylight base plane and the height of the lowermost portions of the respective concave channels increase between said skylight top edge and said skylight bottom edge, whereby the skylight is provided with a generally wedge-shaped configuration in side elevation.

3. The improved skylight of claim 1 wherein said skylight comprises a first unitary member formed from a sheet of synthetic resin.

4. The improved skylight of claim 3 further comprising a second light-transmissive member formed from a sheet of synthetic resin and spaced between convexly curved central portion of said first unitary member and said skylight base plane and extending between said flange portions to form a dead air space between said first unitary member and said second light-transmissive member.

* * * * *